United States Patent [19]

Johnson et al.

[11] Patent Number: 4,601,187

[45] Date of Patent: Jul. 22, 1986

[54] TWISTING APPARATUS AND METHOD

[75] Inventors: Frank Johnson; Sidney D. Akehurst, both of Crowborough, Great Britain

[73] Assignee: The Wellform Engineering Company (Sussex) Limited

[21] Appl. No.: 609,848

[22] Filed: May 14, 1984

[30] Foreign Application Priority Data

May 13, 1983 [GB] United Kingdom ..... 8313162

[51] Int. Cl.[4] ..... B21B 15/02

[52] U.S. Cl. ..... 72/64; 72/371

[58] Field of Search ..... 72/64, 371

[56] References Cited

U.S. PATENT DOCUMENTS

| | | | |
|---|---|---|---|
| 761,880 | 6/1904 | Denk | 72/64 |
| 1,257,435 | 2/1918 | Williams | 72/64 |
| 1,740,612 | 8/1926 | Lowe . | |
| 2,386,172 | 10/1945 | Wisoff | 72/64 |
| 2,457,132 | 12/1948 | Delaney | 72/64 |
| 3,468,146 | 9/1969 | Newman | 72/64 |
| 3,879,975 | 4/1975 | Huhnen | 72/64 |

*Primary Examiner*—Leon Gilden

*Attorney, Agent, or Firm*—Roberts, Spiecens & Cohen

[57] ABSTRACT

Apparatus and method for twisting thin strip material such as thin aluminum strip in which the strip material is guided from a supply of strip material along a feed path 21 to a guide mechanism 11 which maintains the strip in a first plane and is then passed to two rolls 31, 32, at least one of which is driven. The rolls have on their outer circumferential edges 33, 34 grooves 41 which grip opposite edges of the strip, the rolls 31, 32 being mounted so that their axes of rotation are twisted with respect to one another whereby the strip is driven forwards by the rolls 31, 32 and twisted as it passes through the rolls to form a helically twisted strip.

12 Claims, 7 Drawing Figures

TWISTING APPARATUS AND METHOD

FIELD OF THE INVENTION

The present invention relates to twisting apparatus and method. It is particularly applicable to a method and apparatus for twisting strip material so as to form helical strip material.

BACKGROUND AND PRIOR ART

Forming helical strip material is well known and many arrangements for carrying out this method have been desribed. However, the previous methods have not been applicable to twisting a thin material which, although rigid, is for example of a fairly soft material such as aluminum.

An example of a twisting apparatus and method is shown in U.S. Pat. No. 1,740,612. This discloses an apparatus for twisting an I-shaped cross section copper strip which is to form the core of a cable. Because the core is to protect the cable it has to be of a substantial cross section and therefore relatively stiff and can be handled with much less difficulty than thin strips of aluminum. The untwisted strip mounted on a roll 8 is passed between two rolls 56, the roll 8 being rotatable about the axis of the machine. Although the rolls 56 are driven, the main force which drives the strip between the rolls 56 is provided by means of a constantly driven feed wheel or standardizer 10 which draws the twisted material through the rolls 56. Such an arrangement will only be applicable to a relatively stiff strip of material. Also as the roll 8 has to be rotated about the axis of the machine the size of the roll 8 is limited and hence the amount of strip material which can be supplied in one run of the apparatus is severely limited.

Furthermore, there is insufficient control on the feeding of the strip to the rolls 56 for the apparatus to be applicable to very thin strip material.

Thus the apparatus of U.S. Pat. No. 1,740,612 would not be applicable to thin soft material as a strip of aluminum, for example, of a thickness of 0.5 mm.

Thus twisting of a strip of thin aluminum sheet material has been a difficult operation and is particularly difficult to carry out continuously.

SUMMARY OF THE INVENTION

The present invention provides apparatus for twisting strip material of, for example thin aluminum or like alloy comprising means for guiding the strip material along a feed path in such a manner as to retain it in a first plane as it passes said guiding means; two roll means mounted adjacent the guide means for receiving strip directly from said strip guiding means, at least one roll means being driven, although usually both roll means would be driven, each roll means having groove means on its outer circumferential edge, the roll means being adapted so that the groove means engage opposite edges of the strip as it passes therebetween, the roll means being mounted so that their axes of rotation are twisted with respect to one another whereby the strip from the strip guiding means is driven forwards solely by said roll means and twisted as it passes through said roll means to form a helically twisted strip. The apparatus is preferably adapted so that it can run continuously so long as it is fed with strip material.

Because the strip material is driven through the roll means by rotation of the roll means alone, then thinner material may be fed through the apparatus. Furthermore, the provision of the guiding means controls the feed of the strip material to the roll means which is also necessary if thin strip material is to be handled.

The axes of rotation of the rolls are preferably parallel to said first plane. The axes of rotation are preferably at the same angle with respect to the feed path at all times. Means may be provided to vary the angles between the axes of rotation of the rolls and the feed path between a first roll position in which the two rolls are parallel with one another and with the feed path (i.e. their axes are at right angles to the feed path) and a second roll position in which the rolls are at a predetermined angle (e.g. 45°) to the feed path whereby to vary the pitch of the helix.

The circumferential edges of the rolls preferably have curved surfaces leading into and out of their respective groove means.

The strip guiding means may comprise a member with a slot therethrough of cross section similar to the strip. The strip guiding means may be rotatable about the feed path between two positions at right angles to one another.

Means may be provided to drive the rolls at the same speed and in the opposite direction of rotation to one another. To allow for variation of the angle between their axes and the feed path, the drive means may include universal joints.

Means may be provided to cut the helically twisted strip, and this means may preferably comrise two choppers spaced apart from one another and spaced from the roll at such a distance that the part of the twisted strip to be cut by both choppers is correctly aligned with respect to those choppers.

The invention also provides a method for forming a helically twisted strip comprising directing the strip along a feed path in such a manner as to retain it in a first plane to a position adjacent two roll means, passing said strip between the two roll means, the two roll means being driven to drive the strip between the roll means, whereby the outer circumferential edge of said roll means grips the opposite edges of the strip, the two roll means being arranged so that their axes of rotation are twisted with respect to each other to form a helically twisted strip.

BRIEF DESCRIPTION OF THE FIGURES OF THE DRAWING

A preferred arrangement of the invention will now be described by way of example only and with reference to the accompanying drawings in which.

DETAILED DESCRIPTION

Figure 1:
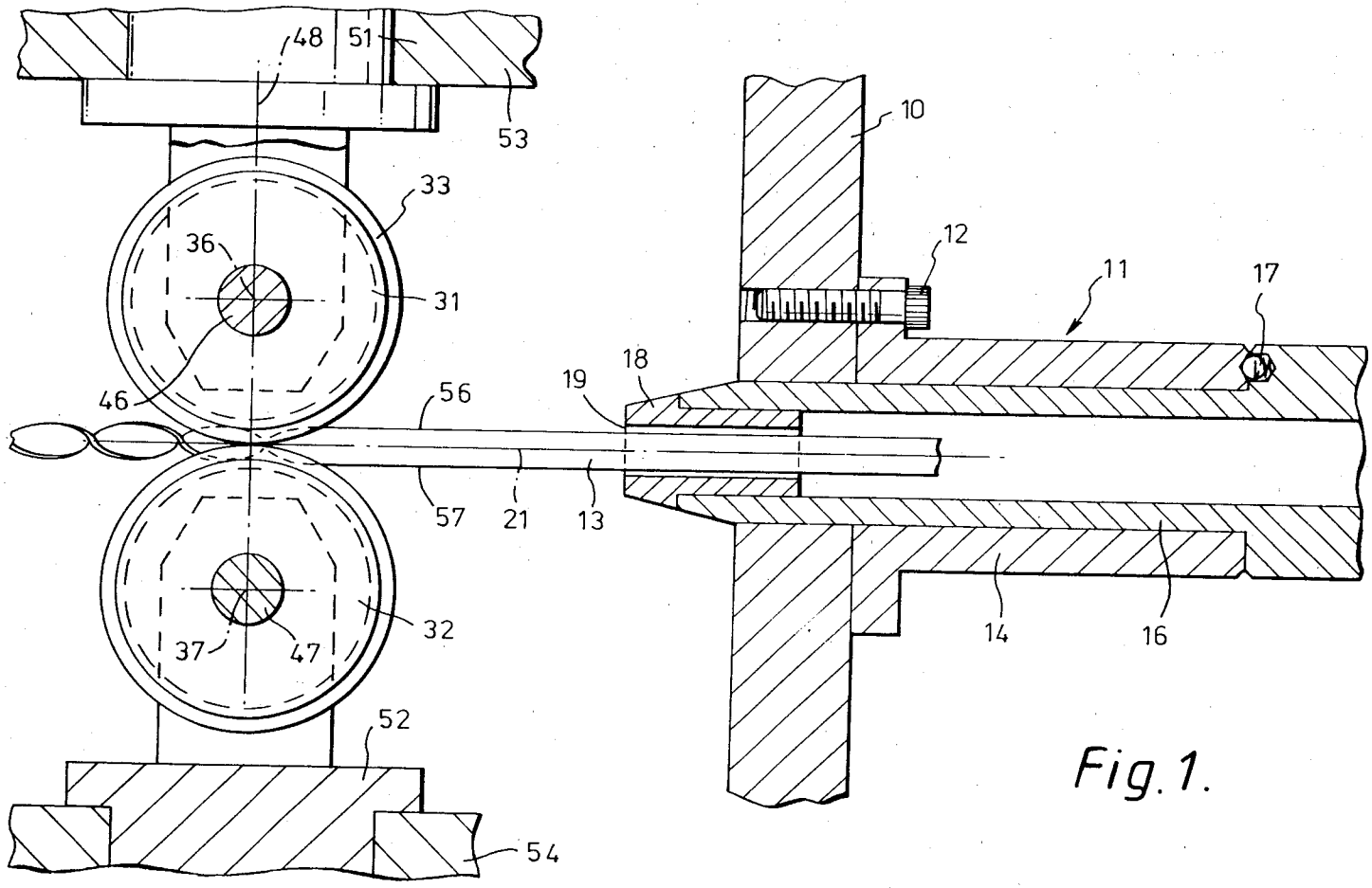
FIG. 1 is a vertical section through part of the apparatus of the invention in a first position, illustrating the method of the invention.
Figure 2:
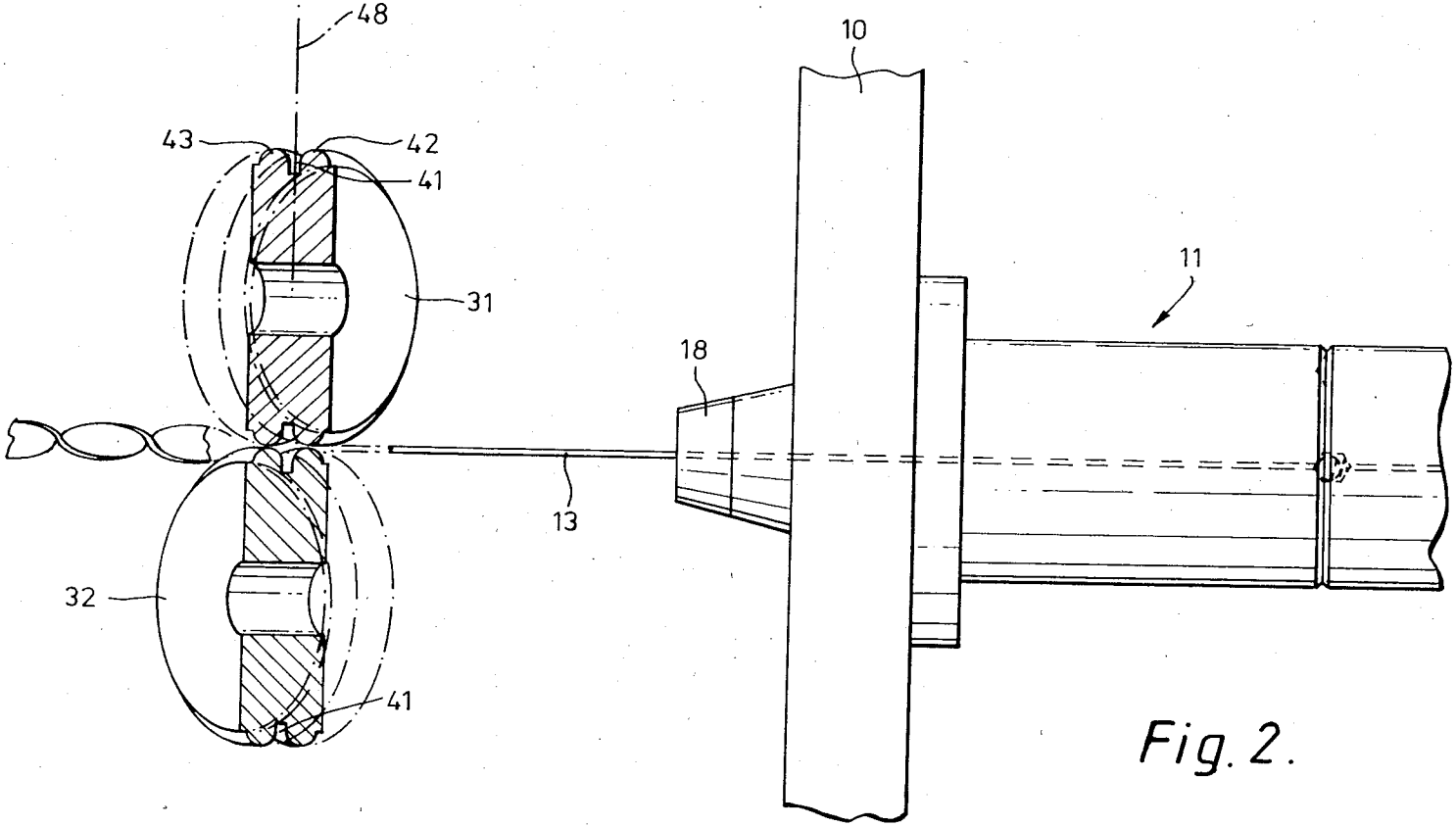
FIG. 2 is a vertical section similar to FIG. 1 but with a part of the apparatus shown in an alternative position.
Figure 3:
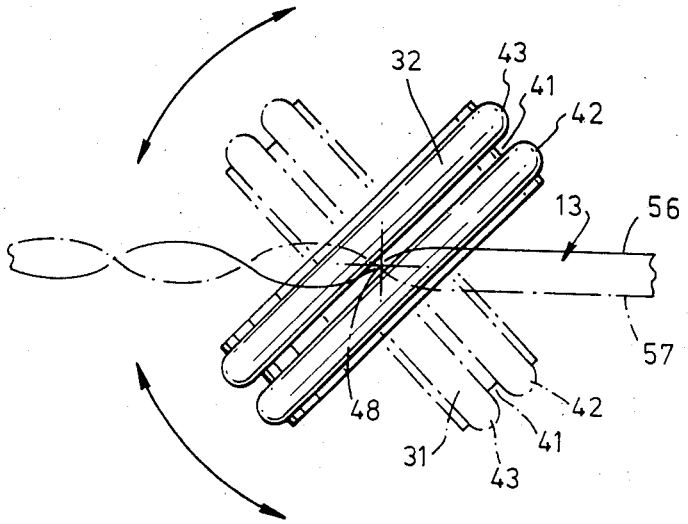
FIG. 3 is a diagrammatic view from above of part of the roll means showing how the strip material passes through them.
Figure 7:
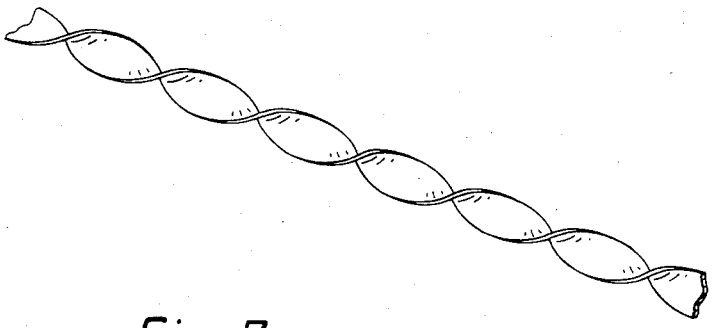
FIG. 6 is a general arrangement of the apparatus of FIG. 4 at an initial stage of operation and FIG. 7 shows a helically twisted strip.

The principle of the invention is most simply described with respect to FIGS. 1 to 3. In FIG. 1 there is shown a mounting plate 10 to which is mounted by set screws 12 guide means 11 for guiding a strip 13 of aluminum. The aluminum strip may be of different widths and thicknesses depending upon the circumstances and in a typical example may be 7.4 mm wide and 0.5 mm thick. It is thin, flexible and easily bent and difficult to handle. The guide means comprises an outer mounting tube 14 within which extends an inner tube 16, the inner tube being mounted within the outer tube 14 adjacent the upstream end, there being provided spring ball detents 17 between the inner tube 16 and outer tube 14. At the downstream end of the inner tube 16 there is a nozzle 18 which includes a slot 19 of cross section slightly greater than but corresponding to the cross section of the strip 13. The nozzle 18 may be readily replaced so as to enable the apparatus to operate with different widths and thicknesses of strip 13. The inner tube 16 may be rotated by hand about its axis which corresponds with the feed path 21 and the spring ball detents 17 cooperate with the outer tube 14 so that the nozzle 18 may be disposed so that its length is at right angles to the plane of FIG. 1 (i.e. a first position which is as illustrated in FIG. 2) or is in the plane of FIG. 1 (i.e. a second position which is as illustrated in FIG. 1).

Downstream from but adjacent to the nozzle 18 are mounted two rolls 31, 32 which in the configuration shown in FIG. 1 are arranged so that their circumferential edges 33 abut the feedpath 21 and the axes 36, 37 of respective rolls 31, 32 are at right angles to the plane of the paper of FIG. 1 and the rolls themselves are coplanar with FIG. 1. Referring to FIG. 3 which shows a plan view of the rolls 31, 32, but in a different relative disposition to that of FIG. 1, it will be seen that the outer peripheral edge 33 of each roll 31, 32 comprises a groove 41 with curved surfaces 42, 43 leading into the groove 41. The width of the groove 41 is approximately the same as the thickness of the strip 13 to be formed.

The rolls 31, 32 are rotatably driven by drive shafts 46, 47 and each roll is mounted so as to be rotatable about the axis 48 which passes through their axes 36, 37 and through the feedpath 21. The means allowing for rotation about the axis 48 comprises journals 51, 52 respectively mounted in mounting plates 53, 54 respectively. The arrangement for rotating the rolls 31, 32 about the axis 48 will be described later but the effect is that the rolls rotate in opposite directions through equal angles.

In use of the apparatus so far described, the inner tube 16 is rotated so that the slot 19 is in the position shown in FIG. 1, that is the slot 19 is in its second position. The rolls 31, 32 are arranged so that they are in the plane of FIG. 1. The leading edge of strip 13 is fed through the slot 19 in nozzle 18 and passed to the rolls 31, 32. Because the grooves 41 of each roll 31, 32 are aligned, the strip 13 will relatively easily pass between the rolls and the opposite edges 56, 57 of the strip 13 will be engaged by grooves 41 of the first roll 31 and second roll 32 respectively. The rolls 31, 32 are then driven so as to draw the strip 13 through the slot 19. Once the strip 13 is in motion, the inner tube 16 may be rotated about the feedpath 21 to a position at right angles to that shown in FIG. 1, that is the position shown in FIG. 2 in which the length of the slot 19 is at right angles to the plane of FIG. 1, in other words, the strip 13 is passed through the slot 19 in a horizontal plane. The inner tube 16 is held in this position by the detents 17.

The rolls 31, 32 are then rotated about their axes 48 in synchronism with one another through equal angles but in opposite directions so that they are twisted with respect to the feed path 21 to a predetermined angle. The exact angle chosen, which may be up to, for example, 45°, will depend upon the helical angle desired. The position now reached is illustrated in FIG. 2 and FIG. 3. In practice the strip 13, which is held in the horizontal plane as it passes through the slot 19 is driven by the rolls and twisted as it passes over the curved surfaces 42, 43 whilst the grooves 41 retain the edges of the strip 13.

It will be understood that the apparatus may now run continuously forming helical strip. The supply of strip may be in the form of a large roll or drum and the size of the roll or drum is not limited by the apparatus described. In other words, a very long length of strip may be fed through the machine.

Even so, there will come a point when the complete supply of strip material from one drum runs out and at that point it is either necessary to restart the apparatus as already described or alternatively to provide means whereby the trailing edge of one length of strip material from one drum is attached to the leading edge of strip material on a new drum of material. This can be dealt with by temporarily stopping the machine, welding the leading and trailing edges together and chamferring so that the overlapping strip will pass through the slot 19.

FIG. 3 is a plan view of the bottom roll 32 with the upper roll 31 shown in dashed lines. One edge 56 of the strip 13 is shown in full line and the other edge 57 is shown in dashed lines. It will be seen that the edge 56 is formed over roll 32 in particular over the curved surfaces as it passes into and out of the groove 41 of the roll 32 and similarly the edge 57 is formed over the roll 31 and in particular the curved surfaces 42 and 43 as it passes into and out of the groove 41 of roll 31. The flat strip 13 is formed into a helically twisted strip by the curved surfaces 42 and 43 and grooves 41 and because the rolls are driven in the same direction to provide the rotation of the stir necessary to make it twist.

Figure 4:
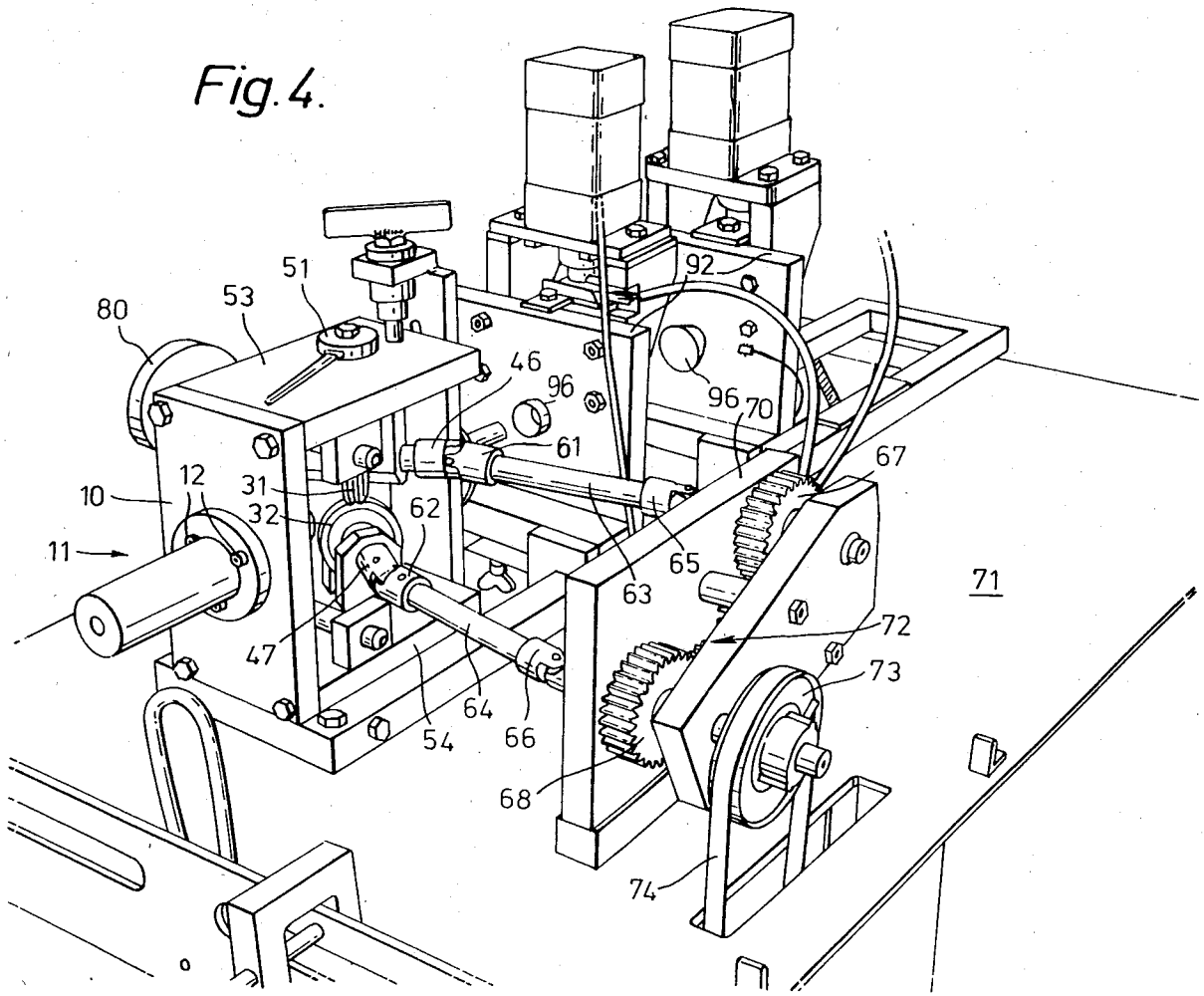
FIG. 4 is a general arrangement of the apparatus from one side.
Figure 5:
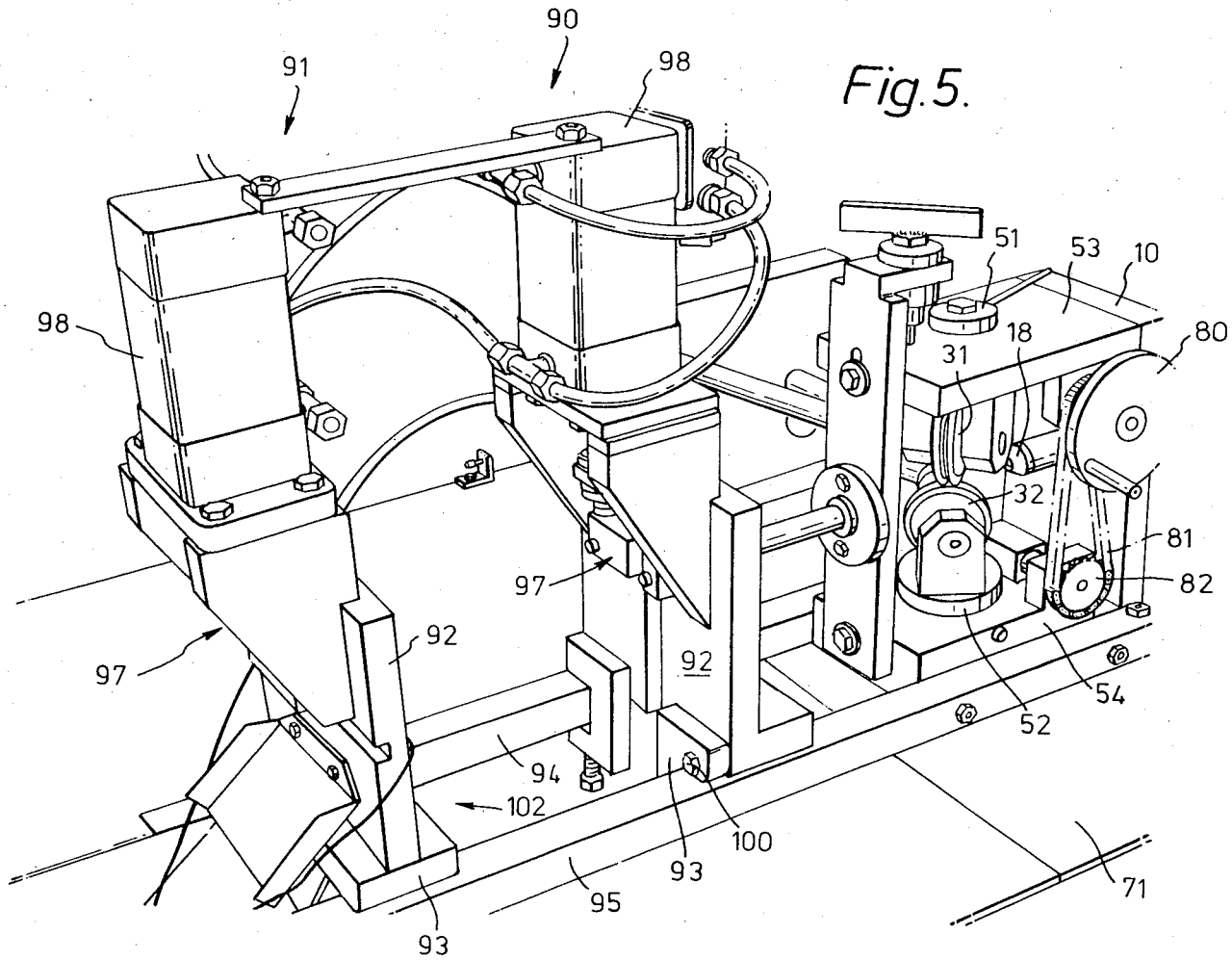
FIG. 5 is a general arrangement of part of the apparatus of FIG. 4 but viewed from the side opposite FIG. 4.
Figure 6:
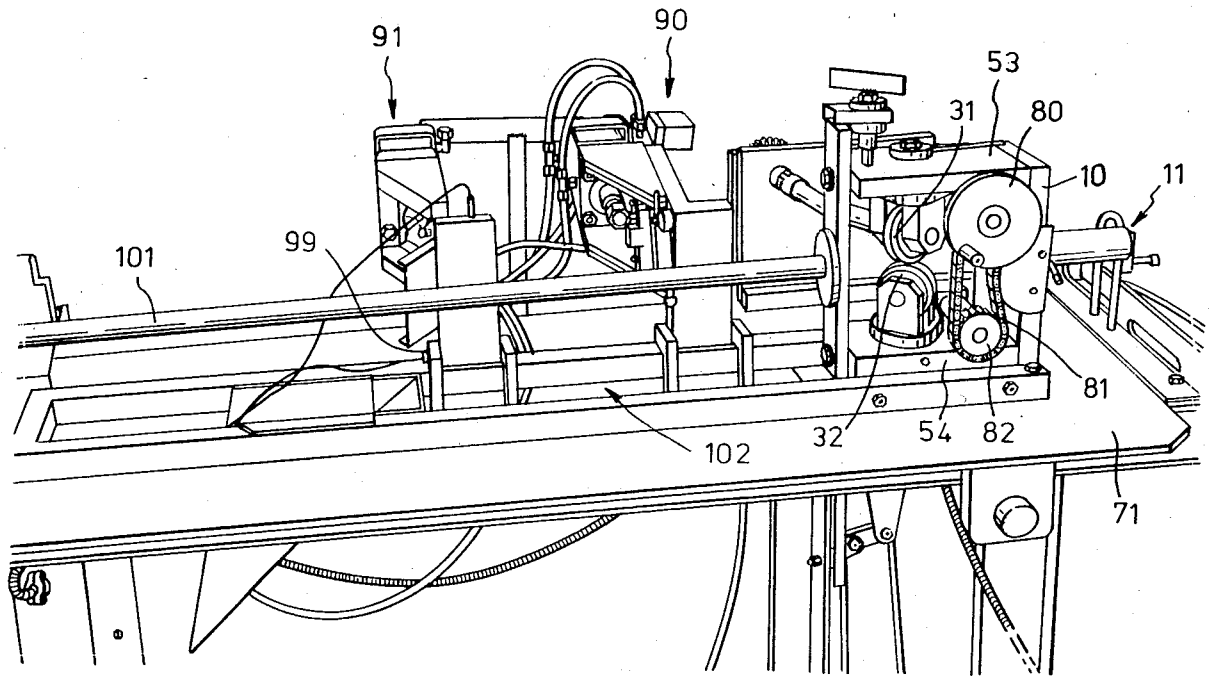

The remaining Figures show the constructional details of the apparatus. In FIG. 4 it will be seen that the drive shafts 46, 47 are driven through respective universal joints 65, 66, the universal joints 65, 66 being attached to pinions 67, 68 respectively mounted in plate 70, the plate 70 being mounted to a table 71. A gear arrangement illustrated generally at 72 is arranged to drive the pinions 67, 68 from a single pulley 73 driven by a belt 74 from a motor, not shown. The universal joints 61, 62, 65, 66 allow drive to pass to the rolls 31, 32 no matter at what angle they are disposed. FIG. 6 shows a handle 80 rotatably mounted to the plate 53, a shaft (not shown) passing from the rear of the handle 80 to drive a screw which in turn drives a nut to rotate the roll 31 about the axis 48 in the journal 51. Drive from the handle 80 is passed by chain 81 to a chain wheel 82 which in turn drives a shaft (not shown) carrying a screw which rotates a nut to rotate the second roll 32 about the axis 48. Manual rotation of the handle 80 causes the rolls 31, 32 to rotate about the axis 48 in synchronism with one another but in opposite directions and through the same angle. FIG. 5 illustrates means by which the helically twisted strip is cut into lengths, and there are provided two chopper means 90, 91 disposed along the feedpath 21 beyond the rolls 31,

32 the chopper means 91 being closer to the rolls than the chopper means 90. The chopper means are generally similar and each comprise an upstanding plate 92 which is mounted by means of a carriage 93 on two rails 94, 95 mounted on the table 71. The carriage 93 and hence each chopper means may be slid along the rails 94, 95 and attached to the rails at a predetermined desired position by suitable clamps.

Each plate 92 includes an aperture 96 aligned with the feedpath 21 through which the twisted strip 13 passes. Mounted immediately adjacent the aperture 96 and arranged to slide across the plate 92 so as to cross the aperture 96 is a blade 97. The blade 97 acts in conjunction with the aperture 96 to form a chopper which will chop the strip passing through the aperture 96. The blade is mounted to reciprocate by means of a hydraulic actuator 98.

Each of the plates 92 are mounted to their respective carriages 93 by pivot means comprising a pivot pin 99 so that on releasing a bolt 100 holding the plate 92 rigidly to the carriage 93 the plate 92 may be pivoted away from the feedpath 21.

During the initial setting up operation described with respect to FIGS. 1 to 3 above, before the rolls 31, 32 reach their final correct angular dispositions, the chopper means 90, 91 are pivoted away from the feedpath 21 as is illustrated in FIG. 6 and a length of strip is formed which is not of the correct configuration and this can be led away through a plastic tube 101. This prevents the leading edge of the strip from getting entangled with the apparatus or hurting the operator. The apparatus is stopped, the pipe 101 is removed, the chopper means are then placed in their correct positions. They can be slid up and down the rails 94, 95 until they reach a position in which, where they are to chop the strip material, it is correctly disposed with respect to the blade 97, that is, exactly at the point where the blade 97 would strike the strip material the strip material is horizontal. When this disposition has been worked out which will depend upon the angle of the helix produced and will depend upon the distance from the rolls 31, 32 and the distance between the chopper means 90, 91, the chopper means 90, 91 are clamped to the rails 94, 95 and the machine set in operation.

The apparatus produces helically rolled strip 13 which is chopped by the chopper means 90, 91 at predisposed intervals which may be determined by a control means, not shown, so as to be in synchronism with operation of the apparatus.

In this way desired lengths of helical strip may be produced, and when chopped off by the chopper means 90, 91 the desired lengths drop down through a hole 102 in the table 71 to be collected.

The invention is not restricted to the details of the foregoing example.

For example, left hand helices or right hand helices can be produced, the rolls either being rotated about their own axes in opposite directions or alternatively the rolls being twisted about the feedpath in opposite directions.

We claim:

1. Apparatus for twisting thin easily deformable strip material comprising: guide means for guiding a strip of material along a feed path in such a manner to retain the strip in a first plane as it passes said guide means, two roll means mounted adjacent said guide means for receiving strip directly from said guide means, means for rotatably driving at least one roll means, each roll means having groove means on its outer circumferential edge, the two roll means being spaced apart by a determined distance so that the respective groove means thereof engage opposite edges of the strip as it passes therebetween, the roll means being mounted so that their axes of rotation are twisted with respect to one another to cause the strip from the guide means to be driven forwards solely by said roll means and twisted without change of its cross section as it passes through said roll means to form a helically twisted strip.

2. Apparatus as claimed in claim 1 in which the axes of rotation of the rolls are parallel to said first plane.

3. Apparatus as claimed in claim 1 or 2 in which the axes of rotation of both rolls are at the same angle with respect to the feed path at all times.

4. Apparatus as claimed in claim 1 or 2 including means to vary the angles between the axes of rotation of the rolls and the feed path between a first roll position in which the two rolls are parallel with one another and with the feed path and a second roll position in which the rolls are at a predetermined angle to the feed path whereby to produce a predetermined helical pitch of the helically twisted strip.

5. Apparatus as claimed in claim 1 in which the circumferential edges of the rolls have curved surfaces leading into and out of their respective groove means, said strip passing over said curved surfaces to undergo twisting while said groove means retains the strip at the side edges thereof.

6. Apparatus as claimed in claim 1 in which the guide means comprises a member with a slot therethrough of cross section corresponding to the strip to be twisted.

7. Apparatus as claimed in claim 1 in which the strip guiding means is rotatable about the feed path between two positions at right angles to one another.

8. Apparatus as claimed in claim 1 comprising means to drive the rolls at the same speed and in the opposite direction of rotation to one another.

9. Apparatus as claimed in claim 8 in which the drive means includes universal joints.

10. Apparatus as claimed in claim 1 comprising means to cut the helically twisted strip.

11. Apparatus as claimed in claim 10 in which the means to cut the helically twisted srip comprises two choppers spaced apart from one another and spaced from the rolls at such a distance that the part of the twisted strip to be cut by both choppers is correctly aligned with respect to said choppers.

12. A method for twisting thin easily deformable strip material comprising directing the strip of material along a feed path in such a manner as to retain it in a first plane to a position adjacent two roll means, passing said strip between the two roll means, driving the two roll means to drive the strip between the roll means in a manner by which, the outer circumferential edges of said two roll means respectively grips the opposite edges of the strip, the two roll means being arranged so that their axes of rotation are twisted with respect to each other to form a helical twist in said strip without changing its cross section.

* * * * *